US007086941B2

(12) United States Patent
Ennis

(10) Patent No.: US 7,086,941 B2
(45) Date of Patent: Aug. 8, 2006

(54) MULTIPOSITION VEHICLE EXHAUST RECOVERY SYSTEM

(76) Inventor: G. Thomas Ennis, 235 W. Florence Ave, Inglewood, CA (US) 90301

( * ) Notice: Subject to any disclaimer, the term of this patent is extended or adjusted under 35 U.S.C. 154(b) by 204 days.

(21) Appl. No.: 10/876,600

(22) Filed: Jun. 28, 2004

(65) Prior Publication Data

US 2005/0287942 A1 Dec. 29, 2005

(51) Int. Cl.
*F23J 11/04* (2006.01)

(52) U.S. Cl. ..... 454/64; 454/65

(58) Field of Classification Search ..... 454/64, 454/65, 92, 341, 358, 903
See application file for complete search history.

(56) References Cited

U.S. PATENT DOCUMENTS

| | | | | |
|---|---|---|---|---|
| 3,698,137 | A | 10/1972 | Overmyer et al. | |
| 3,941,041 | A | 3/1976 | Sprout | |
| 4,086,847 | A * | 5/1978 | Overmyer | 454/64 |
| 4,158,462 | A * | 6/1979 | Coral | 285/144.1 |
| 4,540,202 | A | 9/1985 | Amphoux et al. | |
| 5,159,737 | A * | 11/1992 | Kimura et al. | 15/314 |
| 5,162,017 | A | 11/1992 | Nordin | |
| 5,527,217 | A | 6/1996 | Engstrom | |
| 5,536,206 | A * | 7/1996 | Bodmer et al. | 454/65 |
| 5,630,751 | A * | 5/1997 | Hansen | 454/64 |
| 5,911,623 | A | 6/1999 | Trana et al. | |
| 6,012,978 | A | 1/2000 | Svensson et al. | |
| 6,139,422 | A | 10/2000 | Blaschke | |
| 6,306,031 | B1 | 10/2001 | Hansen et al. | |
| 6,361,427 | B1 * | 3/2002 | Sjoberg | 454/64 |
| 6,524,180 | B1 * | 2/2003 | Simms et al. | 454/65 |
| 2002/0077057 | A1 | 6/2002 | Frink | |

FOREIGN PATENT DOCUMENTS

| | | |
|---|---|---|
| JP | 1-165839 | 6/1989 |
| JP | 2002-106903 | 4/2002 |

* cited by examiner

*Primary Examiner*—Gregory Wilson
(74) *Attorney, Agent, or Firm*—Mattingly, Stanger, Malur & Brundidge, P.C.

(57) ABSTRACT

A multiposition exhaust recovery system for removing vehicle exhaust gases from a plurality of positions in a work area includes a vertical support column, a pair of pivotally attached tubular arms rotatable by separate power means for each arm, a flexible tube connecting the two arms, an exhaust collecting hood connected to one end of the tubular arms and a suction source connected to the other end of the tubular arms. A portable controller controls operation of the system.

13 Claims, 4 Drawing Sheets

MULTIPOSITION VEHICLE EXHAUST RECOVERY SYSTEM

BACKGROUND OF THE INVENTION

1. Field of the Invention

The present invention relates to an improved vehicle exhaust recovery system and, more particularly, to such a system which may be used at a plurality of positions in a work area through the use of a pair of rotatable, pivotally connected arms having a suction source connected to one end and an exhaust collecting hood connected to an opposite end.

2. Description of the Related Art

Numerous devices are known in the art for removing exhaust or other fumes from work areas. Most of the prior art devices, however, are designed for use at a single position rather than being usable at multiple positions in a work area. One known exhaust removal system which is movable to a plurality of positions is shown in U.S. Pat. No. 4,086,847, issued May 2, 1978. The device shown therein includes an elongated duct pivoted at one end to a vertical support and having a second conduit extending downwardly therefrom and movable along a pair of tracks on the first conduit by a car to which the second conduit is attached.

While such prior art devices are generally satisfactory, there, nevertheless, is a need for an improved exhaust removal system capable of operating at multiple positions.

SUMMARY OF THE INVENTION

It is object of the present invention to provide an improved vehicle exhaust recovery system usable at multiple positions in a work area.

It is another object of the invention to provide a vehicle exhaust recovery system usable at multiple positions in a common work area which may easily be adjusted from one position to another where two positions are adjacent to each other.

It is a further object of the invention to provide a vehicle exhaust recovery system usable at multiple positions which is particularly adapted for use in connection with larger vehicles such as busses.

Another object of the invention is to provide a vehicle exhaust recovery system usable at multiple positions wherein an exhaust recovery hood may be movable from one position by mechanisms operated by a portable controller.

The present invention achieves the above and other objects of the invention by providing a multiple position exhaust recovery system for removing vehicle exhaust gases from a work area and which includes a vertical support column having a first tubular arm pivotally attached adjacent an inner end thereof to the column and a second tubular arm pivotally attached to an outer end of the first arm. Separate power means are provided for pivoting each of the arms. A flexible tube connects the outer end of the first arm with the second arm and an exhaust collecting hood is connected to the outer end of the second arm. A suction source is connected to the first arm.

The system further includes a cable connected between the support column and the outer end of the first arm and has a counterweight attached to the cable at the column end thereof. The system further includes a control panel and a portable controller in communication with the control panel for controlling pivotal movement of the arms. In one embodiment, the controller may be connected to the control panel by an electrical cable and in another embodiment the controller includes means for remotely controlling the control panel. The system further includes a pivotable roller guide attached to the column over which the cable passes.

These and other features and advantages of the multiple position vehicle exhaust recovery system of the present invention will become more apparent with reference to the following detailed description and drawings.

DETAILED DESCRIPTION OF THE PREFERRED EMBODIMENTS

Figure 1:
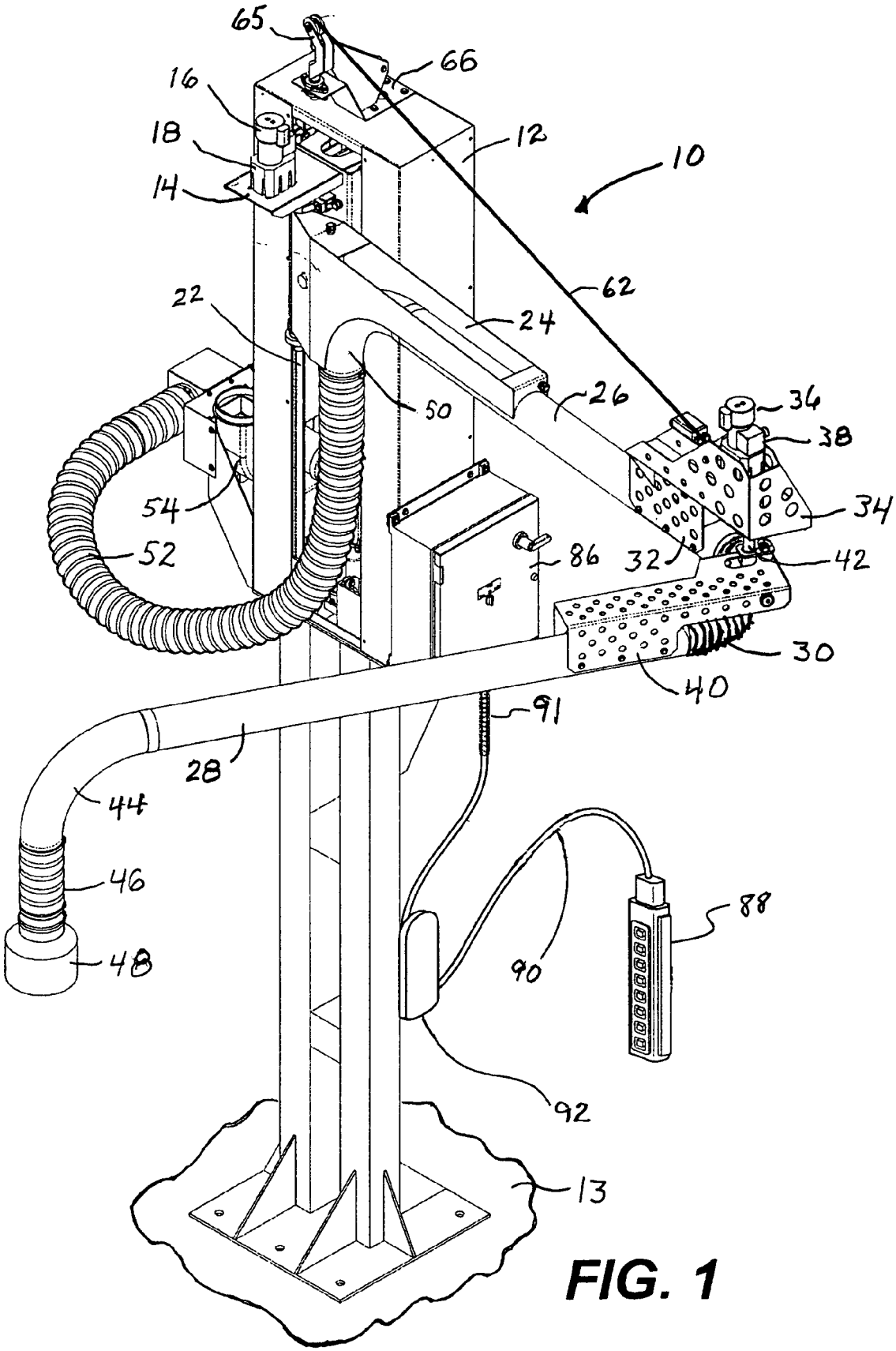
FIG. 1 is a front isometric view of an exhaust recovery system according to the present invention.

Referring to the drawings, an exhaust recovery system according to the present invention, generally indicated by the numeral 10, is shown which includes a vertical support column 12 fixed to a floor 13 of a work area. A support bracket 14 extends outwardly from and is attached adjacent the top portion of the column 12.

A power means such as an electric motor 16 and an associated gear box 18 are mounted on the support bracket 14. A rotatable shaft 22 is mounted on the upper portion of the support column 12 and operatively connected to the motor 16 through the gear box 18. A support arm 24 is mounted to the shaft 22 in cantilever fashion for rotation with the shaft. A first tubular arm 26 is attached to the support arm 24 and a second tubular arm 28 is pivotally attached at its inner end adjacent an outer end of the first tubular arm. Preferably, both the first and second arms are made of aluminum tubing.

A flexible heat resistant hose 30 connects the hollow interior of the first tubular arm 26 with the hollow interior of the second tubular arm 28. The flexible hose permits the second tubular arm 28 to pivot or rotate relative to the first tubular arm 26 without breaking the connection between the two tubular arms.

A perforated bracket 32 is mounted adjacent the end of the first tubular arm 26 and has another perforated bracket 34 attached to the upper surface thereof. A second power means, such as an electric motor 36 having a gear box 38 associated therewith, is mounted to the bracket 34. An elongated bracket 40 is mounted adjacent the inner end of the second tubular arm 28 and is operatively connected to a rotatable shaft 42 extending between the gear box 38 and the bracket 40. With this construction, operation of the motor 36 pivots or rotates the second tubular arm 28 with respect to the first tubular arm 26. The second tubular arm 28 is rotatable through an angle of at least 180° or more with respect to the first tubular arm 26. Operation of the motor 16 pivots or rotates the first tubular arm 24 with respect to the support column 12. The first tubular arm is rotatable through an angle of at least 180°.

Attached to the outer end of the second tubular arm 28 is a curved tubular elbow 44, preferably made of aluminum. Elbow 44 is positioned so that its outer end points downwardly towards the floor 13 of the work area. Another flexible heat resistant tube 46 is attached to the outer end of the tubular elbow 44 and has an exhaust hood 48 attached thereto. Preferably, the exhaust hood 48 is constructed of a flexible, heat resistant material such as high temperature silicon rubber. In addition, the exhaust hood 48 may be provided with an exhaust screen on the inside thereof constructed in the form of an extruded aluminum grate.

Figure 2:
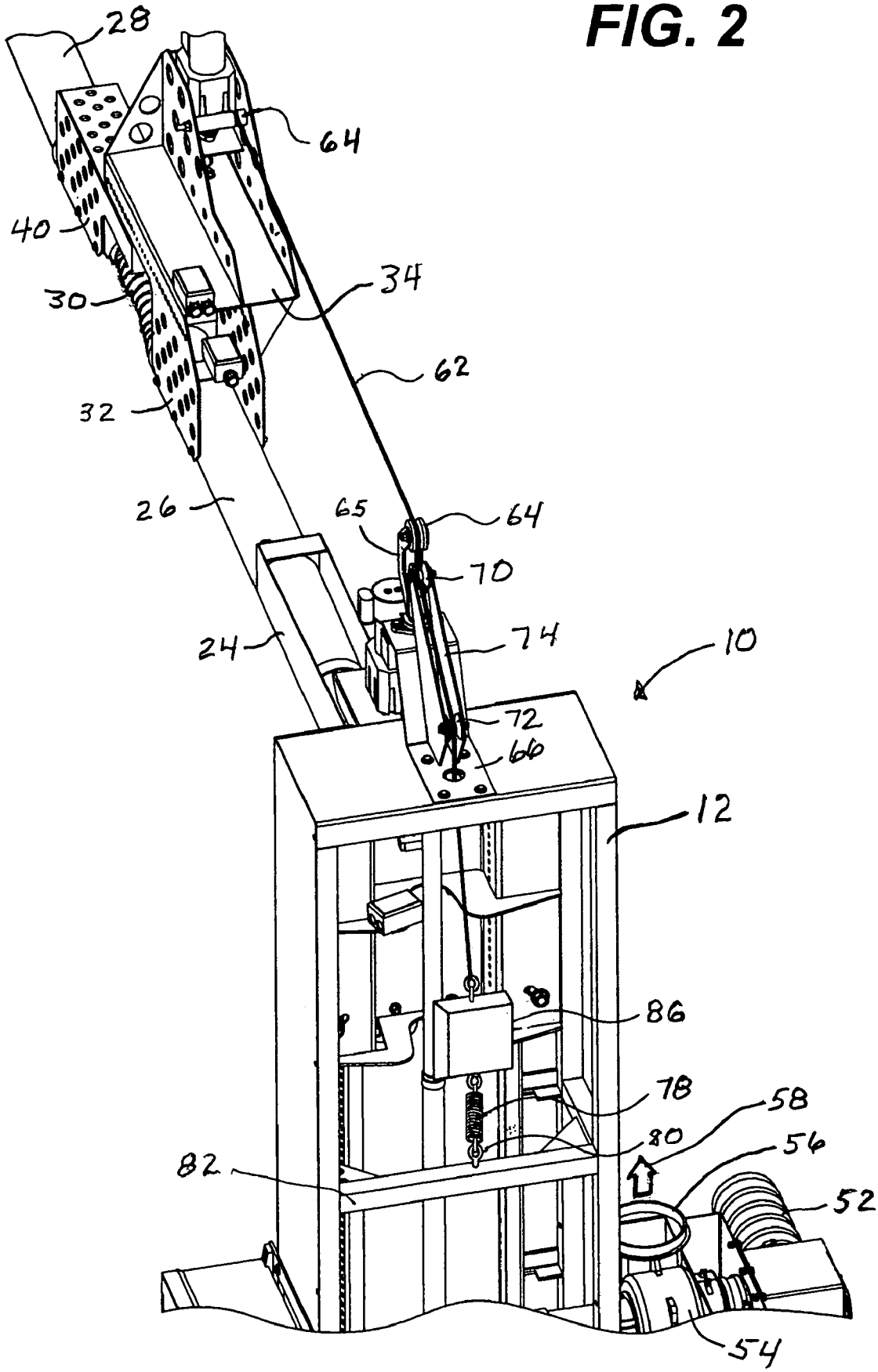
FIG. 2 is an enlarged partial, back isometric view of an upper portion of the exhaust recovery system shown in FIG. 1.

The inner end of the first tubular arm 26 has an elbow 50, preferably made of aluminum, and positioned so that its outer end points downardly. The elbow 50 is supported by the inner end of support arm 24. An elongated flexible hose 52 of heat resistant material is connected to the inner lower end of the elbow 50. A suitable suction source, such as a fan 54, is connected to the outer end of the flexible hose 52. The fan 54 has an exhaust discharge opening 56 through which exhaust gases collected by the exhaust hood 48 are discharged in the direction of arrow 58 as shown in FIG. 2. Although not shown in the drawings, a suitable discharge means, such as a flexible hose, may connect the discharge opening 56 to a suitable discharge point such as an opening extending out of a building in which the work area is located. The exhaust hood 48, flexible hose 46, elbow 44, second tubular arm 28, flexible hose 30, first tubular arm 26, elbow 50 and flexible hose 52 thus form a continuous conduit from the exhaust hood 48 to the suction fan 54 to remove exhaust and other gases from a work area.

As best shown in FIGS. 1 and 2, a support cable 62 extends from the support column 12 to a point adjacent the end of the first tubular arm 26 where it is connected to a roller 64, constructed of an ultrahigh molecular weight plastic material, which is mounted in the bracket 34. The support cable 62 passes over a roller 64 of a pivotal roller guide 65 mounted on a bracket 66 attached to the top of the support column 12. The roller guide 65 pivots in the same direction as the first tubular arm 26 pivots so that it forms a steady guide for the support cable 62. As shown in FIG. 2, after the cable passes over the roller 64 of the roller guide 65, it passes under another roller 70 and over still another roller 72, both of which rollers are mounted on a bracket 74 attached to bracket 66. From the roller 72, the support cable 62 passes through the top of the support column and has a counterweight 86 attached at the inner end thereof. Preferably the counterweight weighs about twenty-five pounds. The counterweight in turn is fastened by a spring 78 to a point 80 on a cross-member 82 of the support column 12. The support cable 62 prevents the cantilevered first tubular arm 26 from falling onto the work floor in case of a structural support failure or in case the arm accidentally comes into contact with a vehicle. The counterweight 76 acts as a counterweight to the weight of the tubular arms 26 and 28.

A control panel 86 is mounted on a side of the support column 12 for controlling the operation of the exhaust recovery system. The control panel in turn may be operated by a portable controller 88 which may be connected thereto by an electric cable 90. The portable controller is of the pendant switch type having a plurality of operating buttons thereon. The electric cable 90 may be connected to the control panel 86 by a strain relief grip 91 employing a wire mesh assembled on the cable. The electrical cable 90 may be wound around and stored on a hanger 92 attached to the support column 12 as shown in FIG. 1. Alternatively, controller 88 may be a remote controller which contains means for remotely controlling the control panel. In this case, an electric cable is not needed to connect the portable controller to the control panel. The portable controller permits an operator to be free to walk around the work area while still controlling movement of the support arms and exhaust hood.

Figure 3A:
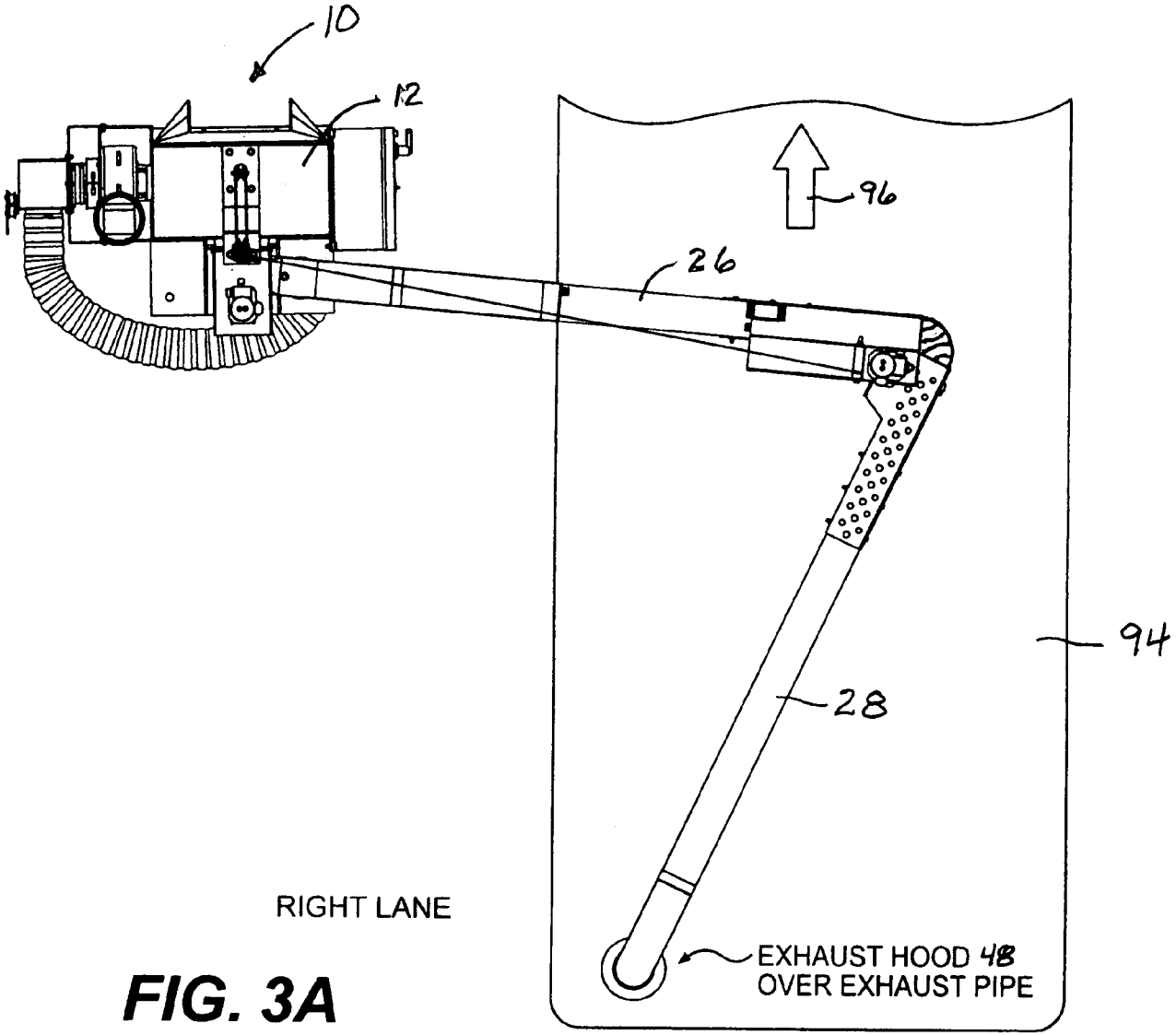
FIG. 3A is a top plan view of the exhaust recovery system showing connected tubular arms positioned so that an exhaust head is positioned over an exhaust pipe of a vehicle in a right lane of a work area.
Figure 3B:
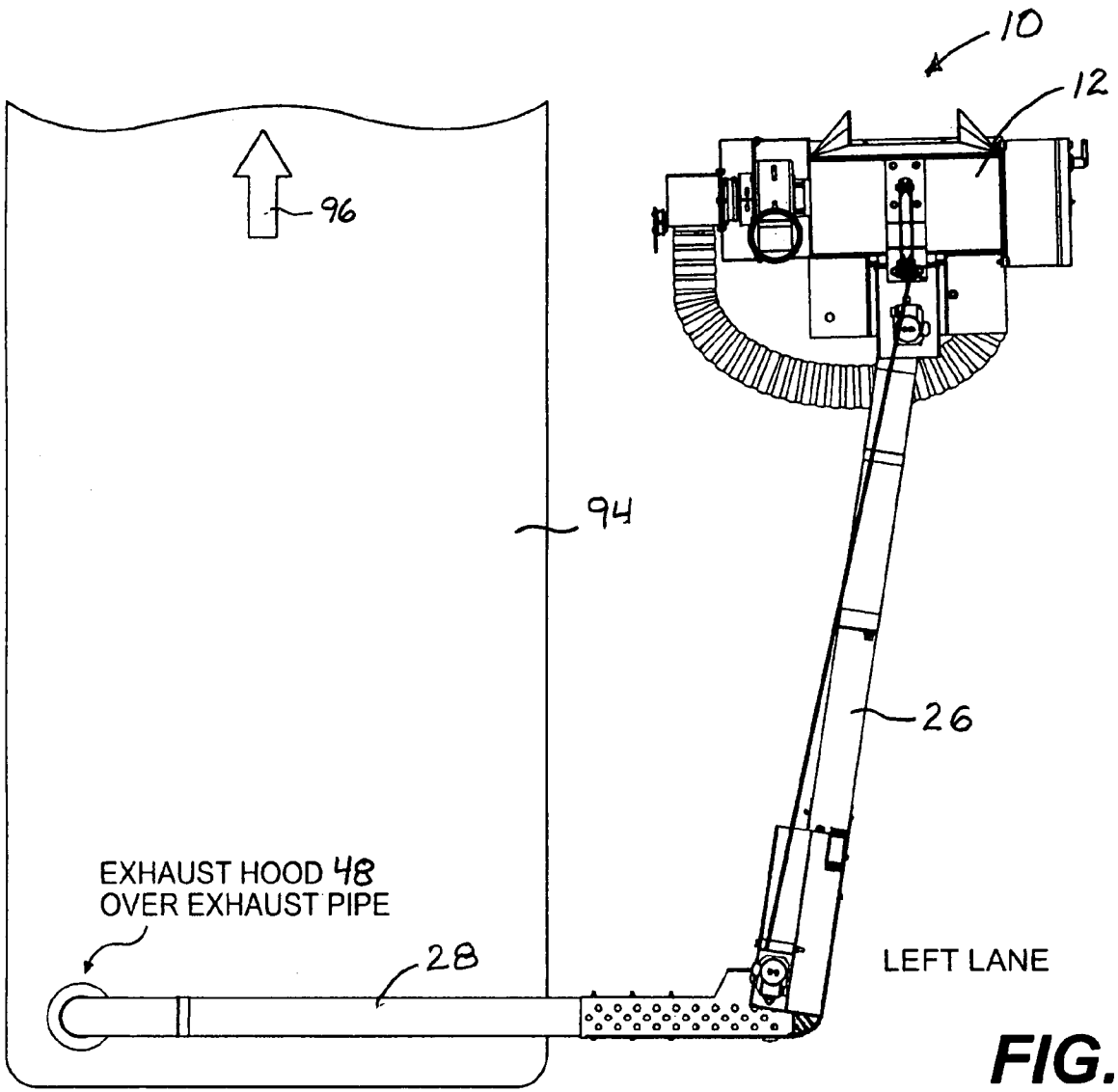
FIG. 3B is a top plan view similar to FIG. 3A showing the exhaust hood positioned over the exhaust pipe of a vehicle in a left lane of a work area.

The pivotal movement of the tubular support arms enables the system to be used at a plurality of different positions in a work space simply by rotating the arms supporting the exhaust hood. Thus, as shown in FIGS. 3A and 3B, the exhaust recovery system 10 of the present invention has the vertical support column 12 and parts attached thereto mounted between a right lane and a parallel left lane of a work space. In each of FIGS. 3A and 3B the system is shown being used with a large vehicle such as a bus 94 having a vertical exhaust pipe adjacent an end thereof. The arrows 96 in FIGS. 3A and 3B indicates a direction of movement of the vehicle such as a bus.

As is apparent from FIGS. 3A and 3B, two vehicles may be placed in spaced, parallel work areas and the exhaust recovery system of Applicant's invention may be mounted in the middle of the two work areas. In this fashion, the exhaust hood of the recovery system can be moved through movement of the tubular arms to a position to recover exhaust from a vehicle in either of the two work areas.

While the drawings show the system for use in connection with busses, the system also may be used in connection with other large vehicles or in connection with automobiles. If the system is used in connection with an automobile, the flexible hose 46 is of a longer length to extend down to the height of the exhaust pipe of the automobile.

Numerous other modifications and adaptations of the present invention will be apparent to those skilled in the art and thus, it is intended by the following claims, to cover all such modifications and adaptations which fall within the true spirit and scope of the invention.

I claim:

1. A multiposition exhaust recovery system for removing vehicle exhaust gases from a plurality of positions in a work area comprising:

a vertical support column;

a first tubular arm pivotally attached adjacent an inner end to said column;

first power means for rotating said first arm;

a second tubular arm pivotally attached adjacent a first end to an outer end of said first arm;

second power means for rotating said second arm with respect to said outer end of said first arm;

a flexible tube connecting said outer end of said first arm with said first end of said second arm;

an exhaust collecting hood connected to a second end of said second arm; and a suction source connected to said first arm.

2. A multiposition exhaust recovery system according to claim 1, which further comprises a control panel and a portable controller in communication with said control panel for controlling pivotal movement of said arms.

3. A multiposition exhaust recovery system according to claim 2, wherein said portable controller is connected to said control panel by an electric cable.

4. A multiposition exhaust recovery system according to claim 3, which further includes a spring attached between said counterweight and said column.

5. A multiposition exhaust recovery system according to claim 2, wherein said portable controller includes means for remotely controlling said control panel.

6. A multiposition exhaust recovery system according to claim 2, which further includes a counterweight attached to said support cable at a column end thereof.

7. A multiposition exhaust recovery system according to claim 1, which further includes a support cable connected between said column and said first arm.

8. A multiposition exhaust recovery system according to claim 7, which further comprises a pivotable roller guide attached to said column over which said support cable passes.

9. A multiposition exhaust recovery system for removing vehicle exhaust gases from a plurality of positions in a work area comprising:

a vertical support column;

a first tubular arm pivotally attached adjacent an inner end to said column;

first power means for rotating said first arm;

a second tubular arm pivotally attached adjacent a first end to an outer end of said first arm;

second power means for rotating said second arm with respect to said outer end of said first arm;

a flexible tube connecting said outer end of said first arm with said first end of said second arm;

an exhaust collecting hood connected to a second end of said second arm;

a suction source connected to said first arm;

a support cable connected between said column and said first arm and having a counterweight attached thereto at a column end thereof; and a control panel and a portable controller in communication with said control panel for controlling pivotal movement of said arms.

10. A multiposition exhaust recovery system according to claim 9, wherein said portable controller is connected to said control panel by an electric cable.

11. A multiposition exhaust recovery system according to claim 9, wherein said portable controller includes means for remotely controlling said control panel.

12. A multiposition exhaust recovery system according to claim 9, which further comprises a pivotable roller guide attached to said column over which said support cable passes.

13. A multiposition exhaust recovery system according to claim 9, which further includes a spring attached between said counterweight and said column.

* * * * *